United States Patent [19]

Mathewson et al.

[11] Patent Number: 4,903,895

[45] Date of Patent: Feb. 27, 1990

[54] SNOW MAKING NOZZLE ASSEMBLY

[75] Inventors: John T. Mathewson, Rte. #44 West, Norfolk, Conn. 06058; Harold Humphrey, Jr., Harwinton, Conn.

[73] Assignee: John T. Mathewson, Norfolk, Conn.

[21] Appl. No.: 322,289

[22] Filed: Mar. 13, 1989

[51] Int. Cl.[4] ..... F25C 3/04

[52] U.S. Cl. ..... 239/14.2; 239/422; 239/430; 239/433

[58] Field of Search ..... 239/2.2, 14.2, 422, 239/433, 430, 429

[56] References Cited

U.S. PATENT DOCUMENTS

| | | | |
|---|---|---|---|
| 4,145,000 | 3/1979 | Smith et al. | 239/14.2 |
| 4,383,646 | 5/1983 | Smith | 239/14.2 |
| 4,516,722 | 5/1985 | Avery | 239/14.2 |
| 4,793,554 | 12/1988 | Krauss et al. | 239/14.2 X |
| 4,813,597 | 3/1989 | Rumney et al. | 239/14.2 X |

*Primary Examiner*—Andres Kashnikow
*Assistant Examiner*—Kevin P. Weldon

[57] ABSTRACT

A snow making nozzle assembly in which streams of water emerge from removable slotted nozzle plates and are injected into a high velocity air stream to atomize the water and project the atomized water into an atmosphere having an ambient temperature below 32 degrees Fahrenheit. The depth of slots in the removable nozzle plates vary to produce a more consistent snow pattern than prior art assemblies. The present invention has a higher operating efficiency due to the ability to easily clean the water nozzles and to adjust the water flow rate to match the existing atmospheric conditions.

4 Claims, 3 Drawing Sheets

SNOW MAKING NOZZLE ASSEMBLY

DESCRIPTION OF PRIOR ART

A large number of patents have issued which are directed to the problem of producing snow like crystals in an effective efficient manner. All of the patented structures produced for this purpose of course use water which is dispersed into an atmosphere having a temperature below 32 degrees Fahrenheit and suspended in this atmosphere for sufficient time to freeze and approximate snow.

In order to accomplish freezing in the relatively short time the water is suspended in the atmosphere it is necessary to atomize the water into finely divided droplets to expose a maximum water surface to the freezing atmosphere. Some patents teach mixing the water and compressed air internal to the snow making structure, still others teach mixing external to the structure. Still others teach the use of fans or impellers to produce an air stream into which water is injected. Although very diverse, all prior art patents have the objective of producing ice crystals that are as like natural snow as is possible in weather where the ambient temperature is below 32 degrees Fahrenheit.

Most economical man made snow producing assemblies are those in which the ratio of the quantity of air moved to the quantity of water converted to ice is the lowest.

There are two prior art patents; 4,145,000 and 4,383,646 which teach the internal mixing of air and water to produce finely divided water droplets to be dispersed in a below freezing atmosphere for the production of man made snow. While these and other prior art devices do accomplish the production of man made snow, changes in the atomizing means and mechanical structure of my present invention improve the efficiency of the assembly, decrease manufacturing costs and simplify maintenance and operation.

BRIEF DESCRIPTION OF THE DRAWINGS

While the novel features of the nozzle assembly in accordance with the present invention are set forth with particularity in the appended claims, a full understanding of the invention may be had by referring to the description of a preferred embodiment as set forth hereinafter and as may be seen in the accompanying drawings in which

DESCRIPTION OF A PREFERRED EMBODIMENT

Figure 1:
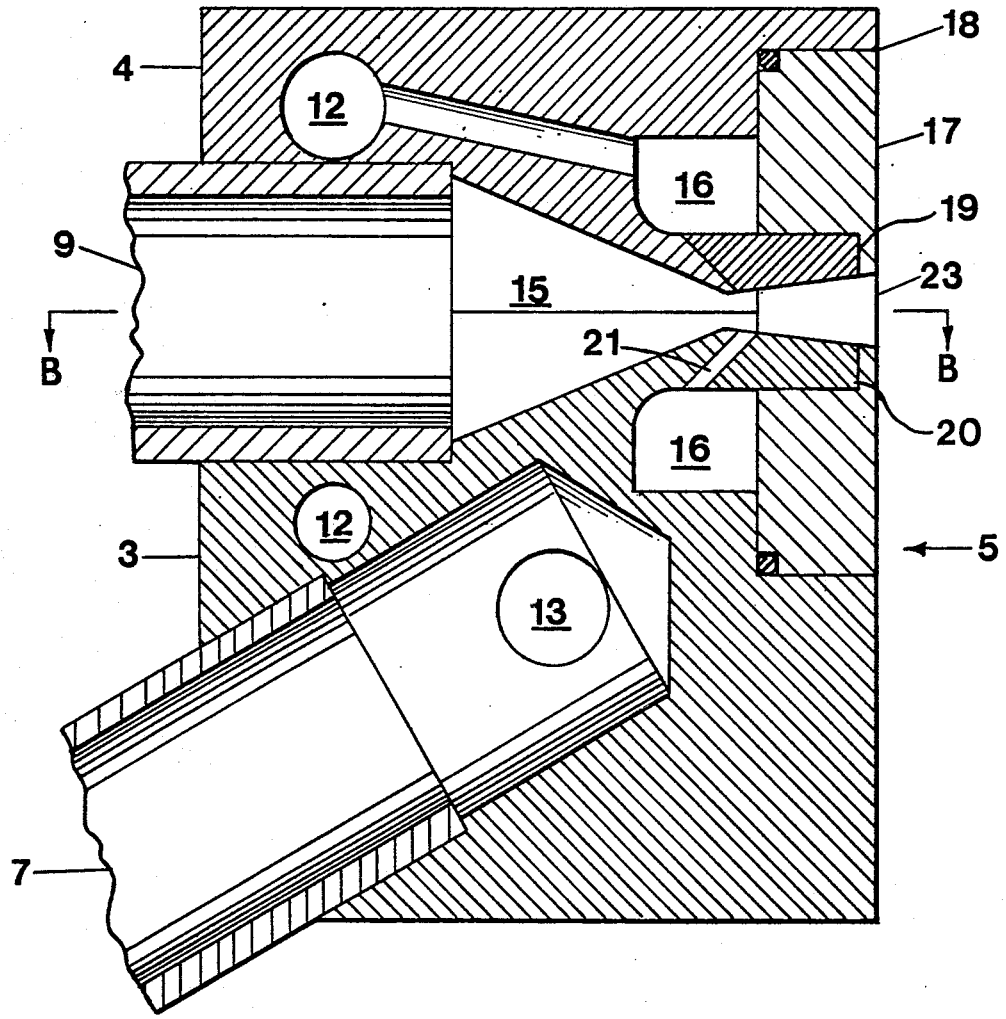
FIG. 1 is a cross-sectioned side elevation view of the snow making nozzle assembly taken along line C—C of FIG. 2.
Figure 2:
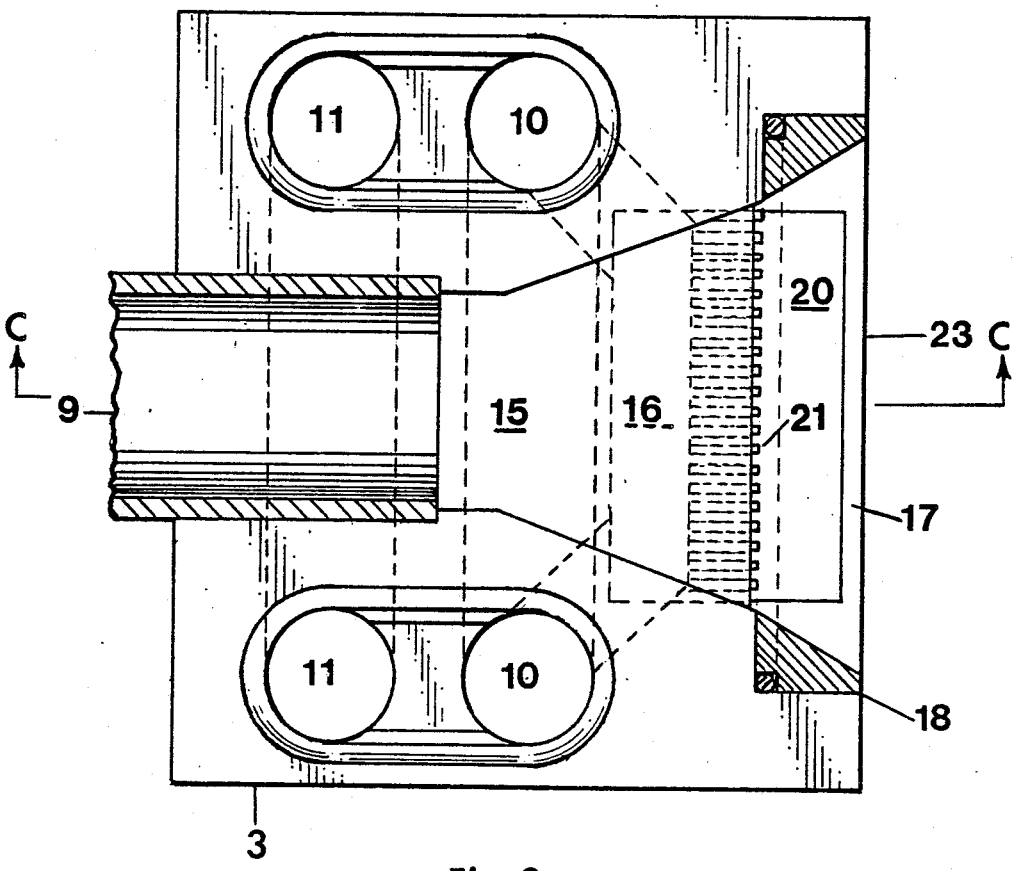
FIG. 2 is a cross-sectioned top elevation view of the snow making nozzle assembly taken along line B—B of FIG. 1.
Figure 3:
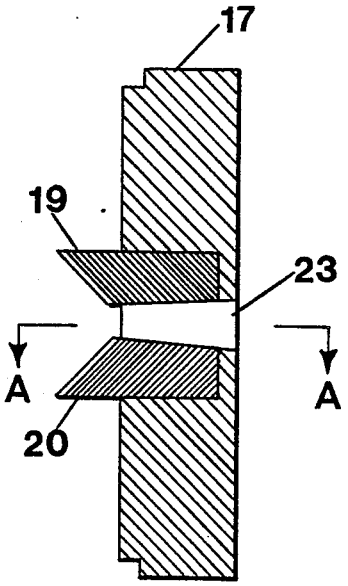
FIG. 3 is a cross-sectioned side elevation view of the nozzle plate carrier.
Figure 4:
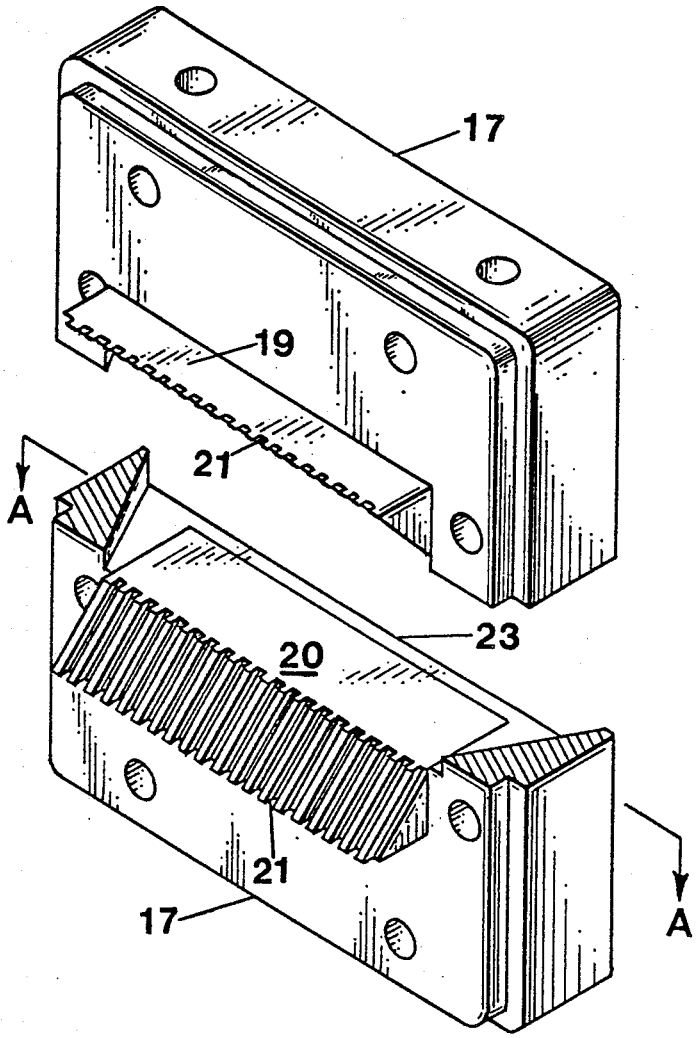
FIG. 4 is an exploded isometric view of the nozzle plate carrier parted along line A—A of FIG. 3.

Turning now to FIG. 1, there may be seen generally at 5 a preferred embodiment of a snow making nozzle assembly in accordance with the present invention. As may be seen in FIG. 1–2, nozzle assembly 5 is composed generally of a two part housing having water and compressed air inlet ports 7 and 9 respectively. The assembly of housing parts 3 and 4 complete the water distribution system in the form of vertically and horizontally connected passages 10, 11, 12, and 13 the assembly of housing parts 3 and 4 also produce converging diverging air nozzle 15, as can be seen in FIG. 1.

Besides delivering water to the discharge manifolds 16, the water distribution system serves the secondary purpose of transferring heat to the outer surface of the converging nozzle 15, and preventing the formation of rime ice in the nozzle 15 and inlet 9.

Figure 5:
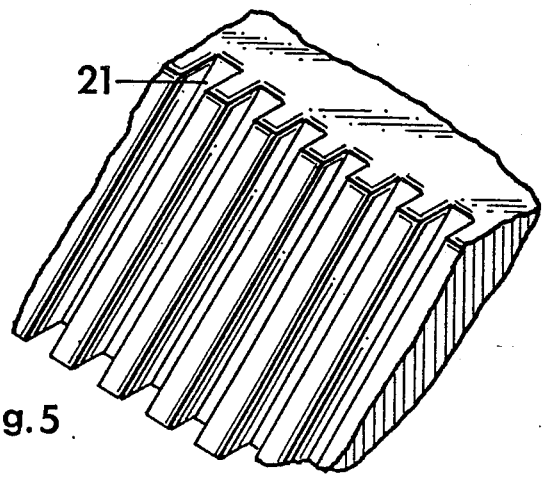
FIG. 5 is an enlarged section of nozzle plate 20 of FIG. 4 showing variation in X-section flow path.

The housing is made in two parts 3 and 4, for ease of manufacture and may be held together by either welding or fastened with bolts and the like, as maintenance, cleaning and adjustments can be performed by access through opening 18 for the nozzle plate carrier 17. The removable nozzle plate carrier 17 is fitted with upper and lower nozzle plates 19 and 20 respectively. Slotted nozzle plates 19 and 20 are made with an equal even number of slots 21 and the slots 21 being positioned so that the slots in either nozzle plate are opposite the land in the opposing nozzle plate. The slots in either nozzle plate intersect the converging diverging nozzle 15, at an angle of approximately 45 degrees to the center line of the converging diverging nozzle 15. The water streams formed by the slotted nozzle plates 19 and 20 are directed toward the exit 23 of the converging diverging flat nozzle 15. The depth of the slots 21 in the slotted nozzle plates 19 and 20 increase from the central slot to either edge of each nozzle plate 19 and 20 by approximately 20% [variation in depth of slots not shown in drawings.] as shown in FIG. 5.

Referring again to FIG. 2, nozzle 15 has a converging diverging shape in top plan view as well as in side cross section as seen in FIG. 1. Nozzle plate carrier 17, fitted with slotted nozzle plates 19 and 20, forms a continuation of the diverging portion of nozzle 15 as well as nozzle exit 23.

In operation the compressed air inlet 9 is connected to a compressed air source capable of supplying 50–500 standard cubic feet of air per minute at a pressure of 50–200 pounds per square inch. Water is supplied to inlet 7 at a pressure of 50–400 pounds per square inch and at a rate of 10–300 gallons per minute.

In contrast to sighted prior art the high pressure streams of water which emanate from the slots 21, in the slotted nozzle plates do not strike each other but are atomized by the high velocity air stream as they leave slots 21. If air is supplied to the air inlet 9 at 103 psi it will attain a velocity of 1005 ft per second upon reaching the point at which the water jets enter the diverging portion of nozzle 15.

In some prior art snow making nozzle assemblies the texture of the snow was not consistent across the area on which snow was deposited. It was often found that an area of wet snow was deposited relatively close to the snow nozzle due to the fact that the snow falling in this area was in contact with the sub freezing atmosphere for a shorter period of time that the snow deposited in a more distant area. It was found that this condition could be reduced or eliminated by reducing the amount of water supplied to the central portion of the converging diverging nozzle 15. This reduction was achieved by reducing the depth of the slots in the central portion of the slotted nozzle plates 19 and 20 by approximately 20%.

The water flow rates and in turn snow production rates can be readily increased as the ambient temperature of the atmosphere decreases, by replacing the easily removable slotted nozzle plates 19 and 20, with nozzle plates having deeper slots.

In most snow making operations the water used in the snow making nozzle is supplied from ponds, lakes, or streams in the vicinity of the area in which the snow will be produced. The water taken from these sources is generally not filtered and contains vegetation, mineral particles, and other debris that clogs the relatively small passages forming the streams of water to be atomized. Unlike other snow making nozzles the easily removable slotted nozzle plates permit removal of clogging debris without the necessity of disassembling the entire snow making nozzle.

While a preferred embodiment of a snow making nozzle in accordance with the present invention has been fully and completely described hereinabove it will be obvious to one skilled in the art that a number of changes in, for example, the shape of the slotted nozzle plated and the water circulation configuration could be made without departing from the true spirit of the invention and that the invention is to be limited only by the following claims.

I claim:

1. A snow making nozzle assembly for use in atomizing water and projecting the atomized water into atmosphere having an ambient temperature below the freezing point of the atomized water to form snow, said nozzle assembly comprising;

a converging diverging flat nozzle extending outwardly from an inlet on the upstream side of said nozzle to an exit on the down stream side of said nozzle, a plurality of spaced water outlet slots machined into removable nozzle plates, said nozzle plates forming an integral portion of upper and lower flat surfaces of said converging diverging nozzle, the width of each of said slots in each of said nozzle plates being equal to the distance between said slots, the depth of the said slots increasing from a center slot of each of said nozzle plates to the outermost slot in said nozzle plates, by at least 20%, said slots being sufficiently angled toward the exit of said converging diverging nozzle to direct the atomized water out of said nozzle;

upper and lower water distribution means overlying said upper and lower nozzle plates;

means for supplying water under pressure to said upper and lower water distribution means for passage through said outlet slots in separate streams for atomization upon impact with a high velocity air stream, the atomized water being carried into the sub freezing atmosphere for the formation of snow.

2. The snow making nozzle of claim 1 wherein said air under pressure is supplied to said inlet of said nozzle at a pressure of between about 50–200 psi.

3. The snow making nozzle assembly of claim 2 wherein said air under pressure has a flow rate of between about 50–500 scfm.

4. The snow making nozzle assembly of claim 3 wherein the water supplied to said water distribution means is supplied at a pressure of between about 50–400 psi and a flow rate of between about 10–300 gpm.

* * * * *